United States Patent [19]

Tanaka

[11] Patent Number: 4,461,599

[45] Date of Patent: Jul. 24, 1984

[54] APPARATUS FOR STORING HEAVY HYDROCARBON OIL AND VESSEL THEREFOR

[75] Inventor: Hiroshige Tanaka, Tokyo, Japan

[73] Assignee: Nihon Sekiyu Hanbai Kabushiki Kaisha, Tokyo, Japan

[21] Appl. No.: 339,623

[22] Filed: Jan. 15, 1982

Related U.S. Application Data

[60] Continuation of Ser. No. 33,956, Apr. 27, 1979, abandoned, which is a division of Ser. No. 886,906, Mar. 15, 1978, abandoned.

[30] Foreign Application Priority Data

| | | | |
|---|---|---|---|
| Mar. 31, 1977 | [JP] | Japan | 52-36590 |
| May 12, 1977 | [JP] | Japan | 52-54786 |
| Jan. 27, 1978 | [JP] | Japan | 53-8023 |
| Jan. 27, 1978 | [JP] | Japan | 53-8024 |

[51] Int. Cl.[3] ..... E02D 27/38

[52] U.S. Cl. ..... 405/210; 114/256; 126/378; 141/82; 220/216; 405/56

[58] Field of Search ..... 405/210, 207, 56, 57, 405/130, 131; 166/302, 57; 114/256; 141/82; 126/378, 208, 210; 220/215, 216, 221, 220, 222

[56] References Cited

U.S. PATENT DOCUMENTS

| | | | |
|---|---|---|---|
| 2,951,348 | 9/1960 | Loveday et al. | 141/82 X |
| 3,339,367 | 9/1967 | Lacy | 405/210 |
| 3,359,739 | 12/1967 | Bishop | 405/56 |
| 3,535,236 | 10/1970 | Travis | 220/216 X |
| 3,685,508 | 8/1972 | Heilmann | 126/378 |
| 3,791,152 | 2/1974 | Davis et al. | 405/210 |
| 3,898,846 | 8/1975 | McCabe | 405/210 |
| 4,020,901 | 5/1977 | Pisio et al. | 166/57 X |
| 4,099,570 | 7/1978 | Vandergrift | 166/302 X |
| 4,136,997 | 1/1979 | Chapman | 405/210 |
| 4,209,271 | 6/1980 | McCabe et al. | 114/256 X |

*Primary Examiner*—Dennis L. Taylor

*Attorney, Agent, or Firm*—Oldham, Oldham, Hudak, Weber & Sand Co.

[57] ABSTRACT

Heavy hydrocarbon oil having a pour point higher at least than the environmental temperature is loaded into a storage vessel in a state heated up to a temperature above its pour point and is cooled down to a temperature below the point to be stored in a solidified form in the vessel. In unloading the heavy hydrocarbon oil stored in the solidified form in the vessel, the upper portion of the oil in the vessel is heated up to a temperature above its pour point, and the successively fluidized oil portions are pumped out of the vessel.

3 Claims, 6 Drawing Figures

APPARATUS FOR STORING HEAVY HYDROCARBON OIL AND VESSEL THEREFOR

This application is a continuation application of application Ser. No. 033,956, filed Apr. 27, 1979, now abandoned, which in turn is a division of Ser. No. 886,906, filed Mar. 15, 1978, now U.S. Pat. No. 4,230,138.

BACKGROUND OF THE INVENTION

This invention relates to a method of storing heavy hydrocarbon oil and a vessel used therefor, in which heavy hydrocarbon oil, for example, crude oil having a high pour point is normally stored in the vessel in a state solidified at the environmental temperature and is heated to be fluidized when required so that it can be conveniently delivered from the vessel.

Various kinds of tanks including a cone roof tank, a floating tank and a dome tank are generally used for the storage of liquid hydrocarbons such as crude oil and heavy oil. However, liquid hydrocarbons containing high-molecular paraffin, wax, etc. in large amounts and having a high pour point, for example, crude oil produced at Minas in Indonesia, crude oil produced at Taiching in China, crude oil produced in Africa, etc. have such a property that they solidify at the atmospheric temperature. According to the prior art practice for storing such heavy hydrocarbon oil in a storage tank, heat has been continuously applied to the oil in the storage tank so as to raise the temperature of the oil up to a level of, for example, 60° C. which is higher by about 15° C. than the pour point, and for this purpose, a bottom heater for steam heating has invariably been installed in the bottom of any one of the tank types including the cone roof tank, floating tank and dome tank. However, even when the entire side wall of such a tank is provided with lagging means for thermal insulation, a large quantity of heat necessarily dissipates to the exterior from the tank side wall occupying a large proportion of the tank surface area, resulting in a high maintenance cost. Further, the problems of liberation of air-polluting gases and deposition of sludge have been unavoidable due to the fact that the oil is stored in its liquid form. Therefore, the storage of the crude oil having such a high pour point has required a higher cost than that having a low pour point and has not been beneficial from the economical standpoint in spite of the fact that such crude oil has a higher caloric value and includes a smaller amount of sulphur.

On the other hand, the aforementioned crude oil containing wax and like components in large amounts and having the high pour point has such a notable property that it shows no fluidity once it solidifies and remains in that state unless heat is applied thereto. Therefore, the crude oil would not leak or flow out of the storage tank even when a crack, a crevice or the like may be developed in the tank side wall or bottom, and even in the event of partial or serious destruction of the storage tank, it would not percolate into the ground in a large amount and can be easily cleared compared with the liquid hydrocarbons, since it is stored in the solidified form. Further, even in the event of flowout from the tank onto the sea, the crude oil of solidified form floats on the surface of the sea so that it can be easily handled or removed and would not contaminate the sea by diffusing along the surface of the sea. Therefore, the storage of the crude oil of this kind in its solidified state is advantageous from the standpoints of prevention of environmental pollution and danger compared with liquid hydrocarbons having a low pour point, and such crude oil is especially suitable for the purpose of storage of a huge amount of oil of this kind over a long period of time.

SUMMARY OF THE INVENTION

It is therefore a primary object of the present invention to provide a method and a vessel which are suitable for the storage of such heavy hydrocarbon oil having a high viscosity or pour point over a very long period of time, and according to which the oil can be relatively easily fluidized when required so that it can be transferred in liquid form from the site of storage.

The method and vessel according to the present invention provide the following advantages:

(1) Storage of crude oil in its solidified form over a long period of time does not cause degradation of quality and precipitation of sludge, and therefore, the crude oil can be stored almost semipermanently without the necessity for exchange.

(2) Losses of light oil components due to volatilization do not occur since the oil is stored in the solidified form. No danger of explosion ensures high safety of storage, and the security distance between the tanks can be greatly reduced.

(3) Damage to the tank containing the crude oil results hardly in the possibility of flowout of the oil from the tank.

(4) Storage of the crude oil in a tank floating on, for example, seawater does not cause contamination of seawater. Therefore, the crude oil can be stored in a tank built in weak ground which is not useful for storage and other purposes, or a tank floating on the sea surface or submerged in seawater. The tank containing the crude oil is free from non-uniform sinking of its foundation and electrochemical corrosion of its bottom plates, which eliminates the prior art necessity for the periodical open tank inspection.

(5) The tank containing the crude oil in its solidified form becomes a rigid body having a mechanical strength high enough to withstand natural disasters including windstorm, flood and earthquakes.

(6) Maintenance of the tank is facilitated, and the maintenance cost can be reduced.

(7) The high safety permits storage of a large amount of crude oil per unit area of the site of storage. Therefore, large-capacity installations can be built in the vicinity of consuming cities, and the cost of transport can be reduced correspondingly.

BRIEF DESCRIPTION OF THE DRAWINGS

Preferred embodiments of the present invention will now be described in detail with reference to the accompanying drawings, is which.

DESCRIPTION OF THE PREFERRED EMBODIMENTS

Figure 1:
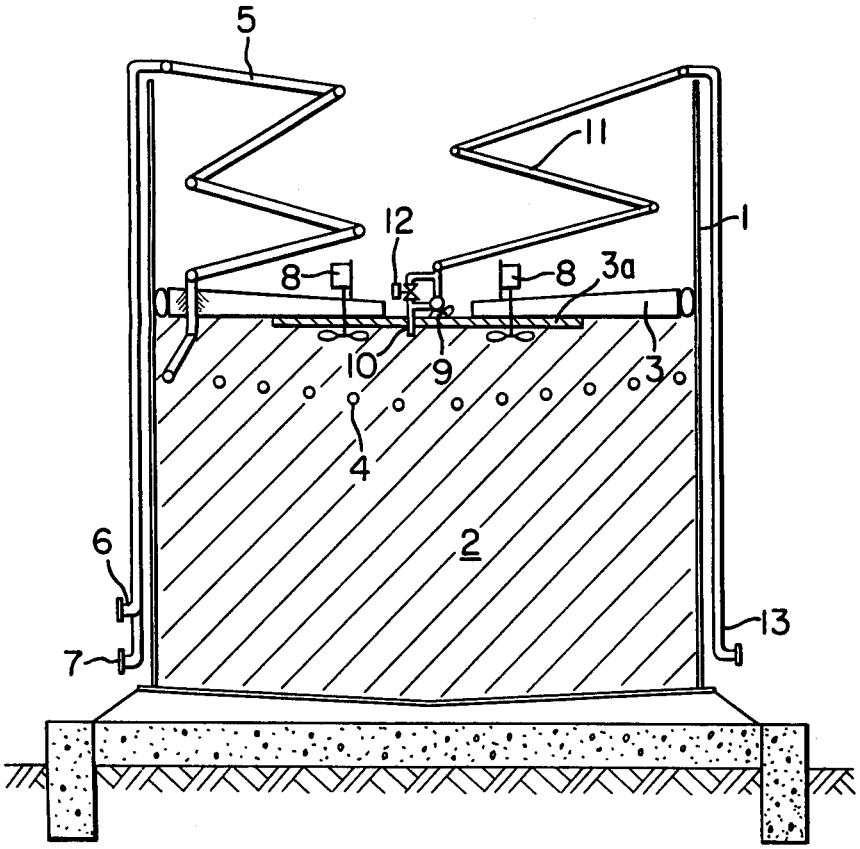
FIG. 1 is a schematic vertical sectional view of a first embodiment of the present invention which is applied to a conventional floating roof tank of the type erected on the ground.

Referring now to FIG. 1 showing a first embodiment of the present invention which is applied to a conventional floating roof tank of the type erected on the ground, this tank has such a structure that its side wall 1 is erected on a strong bottom foundation, and a pontoon-like floating roof 3 and a center cover sheet 3*a* disposed in the internal oil-storing space is afloat on the surface of crude oil 2 stored in the tank. According to this first embodiment of the present invention, a top heater 4 for steam heating is fixed to the lower face of the floating roof 3 and has a heating area which covers substantially the entire area of the oil-storing space. This top heater 4 is connected by a pair of expansible pipes 5 with a heating medium supply conduit 6 and a heating medium discharge conduit 7. A nozzle 10 extends downward from the floating roof 3 in the space between the floating roof 3 and the top heater 4. This nozzle 10 is provided for the purpose of loading and unloading the crude oil into and from the tank and is connected with a crude oil conduit 13 through a valve 12 and an expansible pipe 11. A pump 9 is fixed to the floating roof 3 and communicates with the nozzle 10 and pipe 11 so that the crude oil can be pumped out of the tank when the valve 12 is closed. The reference numeral 8 designates propeller type mixers.

Heavy crude oil having a high pour point is heated up to a temperature above its pour point and is loaded through the conduit 13 into the tank of such a structure. This crude oil is, for example, that produced at Jatibarang (having a pour point of +42.5° C.), that produced at Cinta (having a pour point of +42.5° C.), that produced at Lirik (having a pour point of +40.0° C.), that produced at Tanjung (having a pour point of +40.0° C.), that produced at Minas (having a pour point of +37.5° C.), or that produced at Pematang (having a pour point of +37.5° C.), all these oil fields being located in Indonesia. The crude oil may be that produced at Bahia (having a pour point of +35.0° C.) in Brazil, that produced at Taiching (having a pour point of +32.5° C.) in China, or that produced at Cabina (having a pour point of +25.0° C.) in Africa. The crude oil is stored in the storing space beneath the floating roof 3 as shown in FIG. 1 and is allowed to cool down to a temperature below its pour point. In such a state, therefore, neither volatilization of light oil components nor precipitation of sludge occurs, and the crude oil can be very stably and safely stored in its solidified state without the possibility of flowout and other troubles even in the event of an earthquake or any other natural disasters.

When it is desired to unload the crude oil stored in the solidified form, the top heater 4 is energised to start to heat the upper portion of the crude oil stored in the tank. After the starting of heating operation by the top heater 4, the propeller type mixers 8 are driven to promote convection of the fluidized crude oil portion between the floating roof 3 and the top heater 4. The crude oil portion rendered to possess sufficient fluidity is pumped out by the pump 9 into the conduit 13 through the nozzle 10 and expansible pipe 11. As the surface level of the crude oil goes down, the floating roof 3 moves downward so that the top heater 4 applies now heat to the further lower portion of the crude oil stored in the tank. When, on the other hand, the pump 9 is not driven, and the valve 12 is opened to permit the flow of fluidized crude oil into the tank from the nozzle 10, the surface level of the crude oil rises gradually to cause corresponding upward movement of the pontoon-like floating roof 3.

Figure 2:
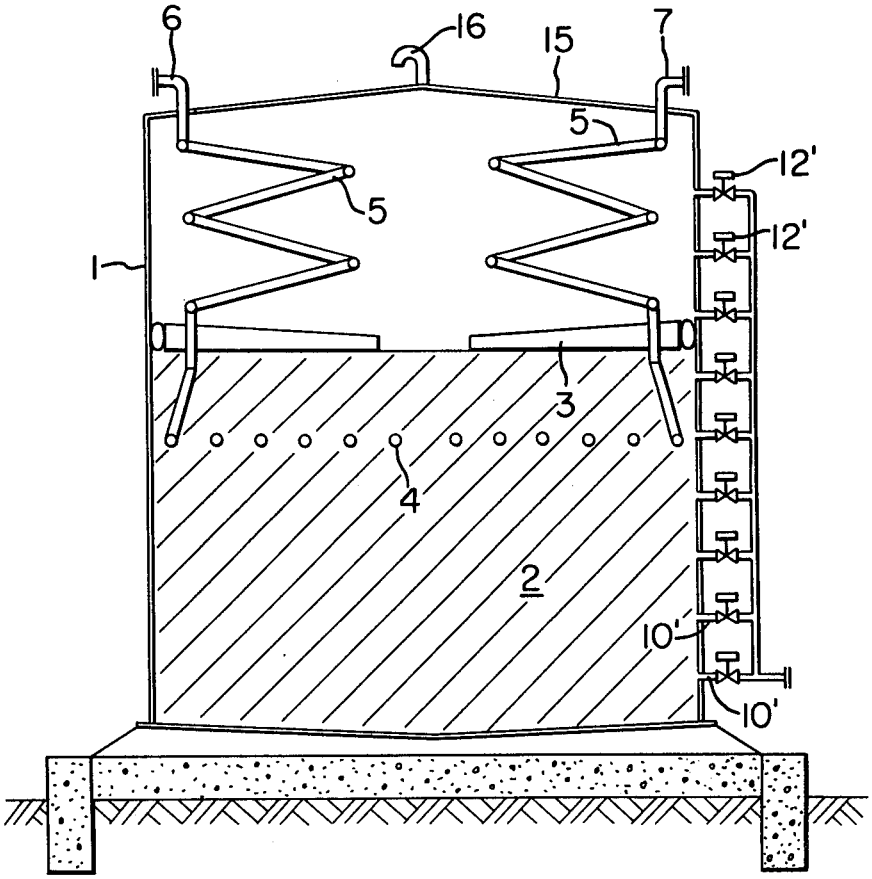
FIG. 2 is a schematic vertical sectional view of a second embodiment of the present invention which is applied to a conventional cone roof tank of the type erected on the ground.

In a second embodiment shown in FIG. 2, the present invention is applied to a conventional cone roof tank. In FIG. 2, the same reference numerals are used to denote the parts common to the first embodiment shown in FIG. 1. Referring to FIG. 2, the reference numerals 15 and 16 designate a cone roof tank top and its air vent respectively. In this second embodiment, a plurality of loading and unloading nozzle 10′ are disposed along the tank side wall 1 at a plurality of vertically spaced levels and are each provided with a valve 12′. This arrangement eliminates the expansible piping 11 and pump 9 employed in the first embodiment. In this second embodiment, therefore, the stored crude oil can be unloaded from the tank by opening the valve 12′ located at the level corresponding to the position of the top heater 4 which moves upward and downward with the floating roof 3 as the corresponding layer of the crude oil is fluidized. It is to be noted that the other features are entirely the same as those of the first embodiment.

Further, although not specifically illustrated as an embodiment, it is apparent that the present invention is equally effectively applicable to a conventional dome tank by providing a floating body or floating roof having a top heater similar to that described above. It will be thus seen that the present invention is easily advantageously applicable to any one of existing tanks by merely making a partial reconstruction thereof In a third embodiment shown in FIG. 3, the present invention is applied to an underground tank built in weak ground as in a reclaimed land.

Figure 3:
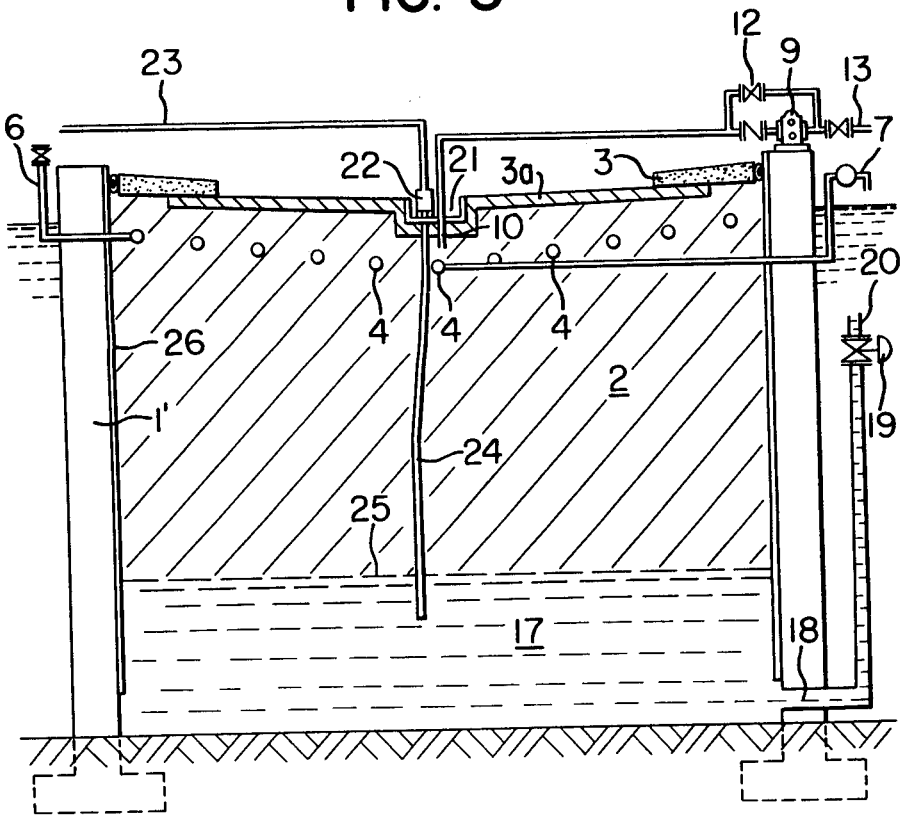
FIG. 3 is a schematic vertical sectional view of a third embodiment of the present invention which is applied to an underground tank built in weak ground.

Referring to FIG. 3, the reference numeral 1′ designates an underground side wall of circular shape built up in a cavity formed by excavating ground to a suitable depth to define a crude oil-storing space therein. The earth removed by the excavation is advantageously piled up along the outer periphery of the top end of the side wall 1′ to increase or substantially double the tank capacity. Even when the tank side wall has thus a height which may be about two times the depth of the cavity measured from the original ground level, the ground portion forming the tank bottom will sufficiently withstand the load to be borne by the tank in view of the fact that the specific gravity of the crude oil stored in the tank is only about 0.85. The shape of the side wall 1′ of the tank thus constructed is not limited to the circular shape and may be a polygonal shape or more generally a square shape.

A floating roof 3 like that used in the aforementioned embodiments and having a center cover sheet 3*a* is provided in the internal space of the side wall 1′. Since this floating roof 3 does not make appreciable vertical movement within the tank, it may be substantially fixed to the top of the side wall 1′. A simple roof may be used in place of the floating roof 3. A top heater 4 is shown fixed to the side wall 1', but it may be fixed to the floating roof 3 as in the aforementioned embodiment.

The reference numeral 10 designates a crude oil loading and unloading nozzle, and this nozzle 10 communicates with a crude oil conduit 13 through a pipe, a valve 12 and a pump 9. The crude oil 2 loaded into the tank through this nozzle 10 is allowed to cool down until it takes its solidified state as described hereinbefore. The lower portion of the crude oil stored in the solidified form in the tank borders on a layer 17 of seawater through a boundary 25. This underlying seawater layer 17 communicates with the open sea (not shown) through a lower conduit 18, a control valve 19 and an upper conduit 20, or with a water level control device (not shown). It is apparent that the bottom of this underground tank need not be closed when it communicates with the open sea.

A rainwater pool 21 is provided at the center of the floating roof 3 and communicates with the exterior through a drain pump 22 and a drain conduit 23 connected thereto or with the underlying seawater layer 17 through a drain conduit 24.

A steam piping or a planar heat generator layer 26 is disposed on the inside face of the tank side wall 1' so as to heat the stored crude oil up to a temperature above its pour point. When so required, in addition to or in place of such a heating means, a coating of material such as teflon or epoxy resin may be provided on the inside face of the tank side wall 1'. The provision of the coating of such material is effective in that the material has a low coefficient of friction and possesses such a property that it is hardly wetted by the crude oil.

when now it is desired to store crude oil in this tank, seawater in the vicinity of the top heater 4 is first heated by the top heater 4 up to a temperature higher by more than 10° C. than the pour point of the crude oil, and then, the crude oil heated up to approximately the same temperature is fed into the zone directly beneath the floating roof 3 through the conduit 13, valve 12 and nozzle 10.

Although not shown, the crude oil is preferably forced out of the tip of the nozzle 10 in a horizontal direction in this case so as to prevent the crude oil from mixing with seawater. The crude oil is fed into the tank while displacing the seawater in the lower portion of the tank through the lower seawater discharge conduit 18 until its surface level is stabilized at the position balanced with the head of seawater. The relation between the crude oil level and the seawater level in the tank is given by $H_0=(d/d_0)H$, where d is the specific gravity of crude oil, $d_0$ is the specific gravity of seawater, $H_o$ is the height of crude oil between the oil-seawater boundary 25 and the crude oil level in the tank, and H is the height of seawater between the oil-seawater boundary 25 and the open sea level. Since $d_0 < d$, the crude oil level balances always at the position higher than the open sea level.

The height of the tank side wall 1' is suitably selected so that seawater may not flow into the tank over the top of the side wall 1' due to the waves caused by wind tide. to this end, the top of the side wall 1' should be higher than the open sea level by at least more than $H_o=H$, or the crude oil level in the tank should be controlled by controlling the amount of seawater in the layer 17 by the control valve 19. The vertical movement of the crude oil level in the tank due to the tide or waves can also be dealt with by controlling the amount of seawater in the layer 17 by the control valve 19. Rainwater accumulating on the upper face of the floating roof 3 flows down into the rainwater pool 21 and is drained to the exterior by the drain pump 22 and drain conduit 23 or into the underlying seawater layer 17 by the drain conduit 24.

When the crude oil loaded into the tank is brought into contact with the inside face of the tank side wall 1', its temperature is lowered until finally it starts to partly solidify at a temperature lower than the pour point. The control valve 19 is then closed in order to prevent the crude oil in the tank from being externally affected by the seawater level and waves. The temperature of the stored crude oil is gradually lowered, and solidification begins in the crude oil portion whose temperature is reduced to a point below the pour point. Finally, the entirety of the stored crude oil is cooled down to a temperature below the pour point and is turned into a jelly-like solidified state which is suitable for the stable and safe storage or for the storage over a long period of time when so required.

When it becomes necessary to unload the crude oil stored in the tank in the solidified state suitable for the storage over a long period of time, the control valve 19 is opened, and the heating means 26 which may be the heat generator layer provided on the inside face of the tank side wall 1' is energized to heat the crude oil portion in contact with such face up to about the pour point thereby fluidizing this crude oil portion. The top heater 4 is also energized to fluidize the solidified crude oil portion lying above the top heater 4, and the pump 9 is driven to pump the fluidized crude oil portion out of the tank through the nozzle 10. With the unloading of the upper portion of the crude oil stored in the tank, the corresponding amount of seawater is drawn into the lower part of the tank to force upward the crude oil layer 2 which remains still in the solidified state. The oil level of the crude oil layer 2 rises to the position above the top heater 4, and the upper portion of the remaining solidified crude oil is heated by the top heater 4 to be fluidized thereby. In this manner, the surface level of the crude oil in the tank is always maintained at substantially the same position, and the pontoon-like floating roof 3 makes limited vertical movement of very short stroke.

Therefore, the crude oil stored in the tank can be continuously unloaded at a proper rate when the heating capacity of the top heater 4 heating to fluidize the crude oil is selected to balance with the pumping capacity of the pump 9.

When it is desired to load an additional amount of crude oil into the tank in the state in which the crude oil is stored in its solidified form in a portion of the tank, the closed control valve 19 is opened, and the heat generator 26 provided on the inside face of the tank side wall 1' is energized together with the top heater 4 so as to fluidize the crude oil portion lying above the top heater 4. Then, the additional amount of crude oil heated up to a temperature above the pour point is fed into the tank through the conduit 13. The crude oil layer 2 stored in the solidified form in the tank is forced downward by the newly fed crude oil while displacing the corresponding amount of seawater 17 so that the necessary amount of crude oil can be stored in the tank.

The heating by the heaters 26 and 4 is stopped, and the control valve 19 is closed when the crude oil is to be stored for a long period of time in its solidified state.

In the third embodiment above described, the planar heat generator and/or the low-friction coating is employed. However, due to the fact that the crude oil stored in its solidified form in the tank has a large bottom surface area and its portion in contact with the inside face of the tank side wall is, at it were, in the form of grease, impartation of a slight pressure or vacuum to its bottom will sufficiently permit vertical movement of the solidified crude oil during loading and unloading thereof without the provision of the aforementioned heat generator and/or the low-friction coating.

Figure 6:
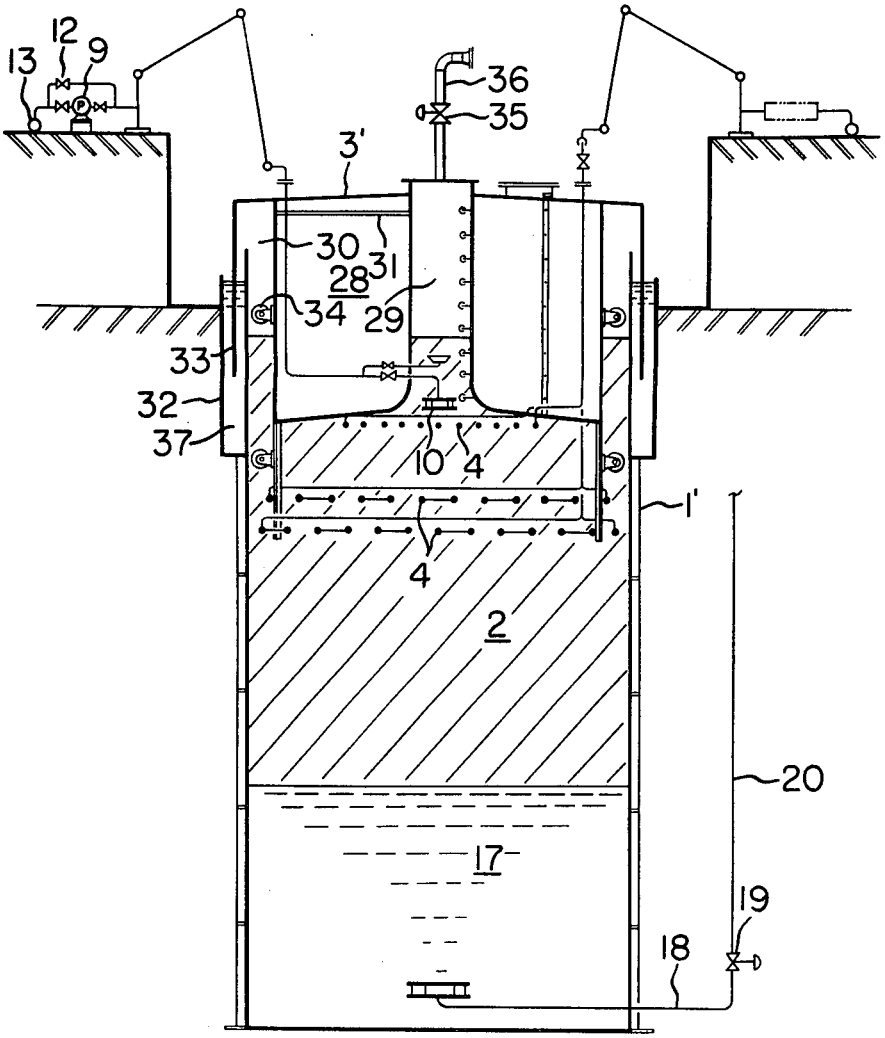
FIG. 6 is a schematic vertical sectional view of a modification of the third embodiment, in which the outer periphery of the floating roof of the underground tank is sealed with water.

FIG. 6 shows a modification of the third embodiment. In FIG. 6, the same reference numerals are used to denote the same parts appearing in FIG. 3, and detailed description of such parts is omitted. In this modification, the floating roof 3' comprises a doughnut-like buoyant chamber 28' defining a cylindrical chamber 29 in the center thereof. The outer peripheral edge of the floating roof 3' extends outward beyond the tank side wall 1' to terminate in a depending portion 33 which is received in a water-filled sealing chamber 37 defined between the top portion of the tank side wall 1' and an outer wall 32 surrounding this top side wall portion and connected at its bottom to the tank side wall 1'. Therefore, an outer peripheral chamber 30 is formed between the outer wall 32 and the outer periphery of the doughnut-shaped sealing chamber 28'. This outer peripheral chamber 30 communicates with the cylindrical chamber 29 through a pipe 31. An opening in the top of the cylindrical chamber 29 communicates with a vent 36 through a valve 35. Guide rollers 34 are provided to make rolling engagement with the inside face of the tank side wall 1' during vertical movement of the floating roof 3'.

This modification is especially advantageous in that gases liberated during loading of crude oil and during heating of the upper portion of the stored crude oil for the purpose of unloading are confined within the chambers 29 and 30 without escaping to the exterior. The liberated gases can be fed through the valve 35 and vent 36 to a site of treatment.

In the case of the third embodiment, these liberated gases tend to escape to the exterior through the gap between the floating roof and the tank side wall thereby inducing danger and environmental pollution in addition to losses of crude oil stored in the tank. The modification shown in FIG. 6 obviates entirely such problems.

Figure 4:
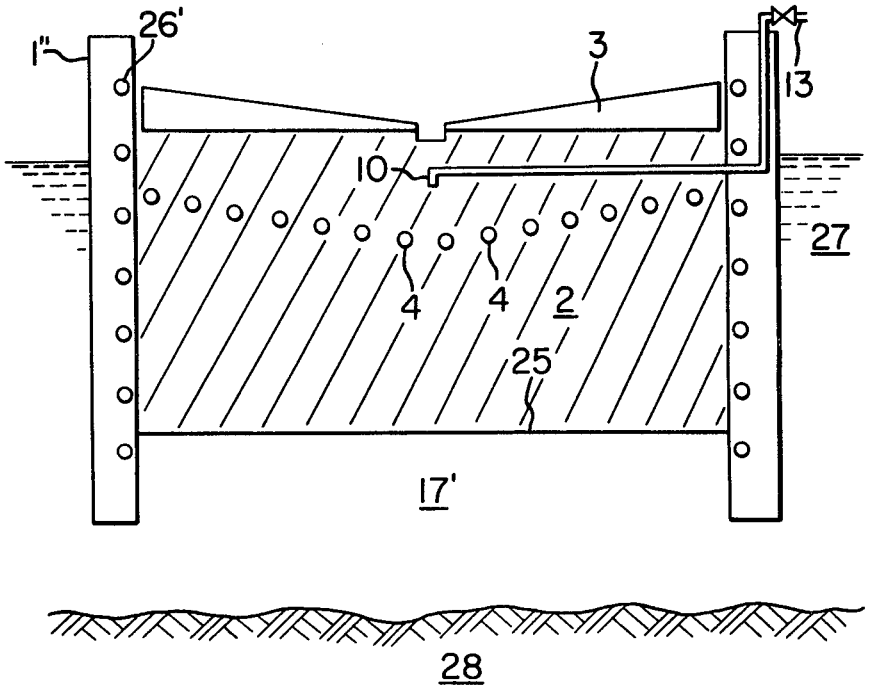
FIG. 4 is a schematic vertical sectional view of a fourth embodiment of the present invention which is applied to a sea-borne tank moored to the sea bottom and floating on the sea surface.

In a fourth embodiment shown in FIG. 4, the present invention is applied to a sea-borne tank.

This sea-borne tank comprises a buoyant side wall 1'' and a roof, for example, a pontoon-like floating roof 3, and the bottom of the tank is open to communicate with seawater. A top heater 4 may be fixed to the floating roof 3 or to the side wall 1''. A crude oil loading and unloading conduit 13 is connected with a nozzle 10 disposed in the upper central position in the tank. Such a tank may be anchored to the sea bottom 28 or moored to the land or a breakwater.

Heavy crude oil heated to be fluidized is fed into the tank through the conduit 13 and nozzle 10 to be stored in the tank as in the aforementioned embodiments. The crude oil portion fed into the zone directly beneath the floating roof 3 displaces the corresponding amount of seawater 17' from the lower end of the tank due to the difference between the specific gravity of crude oil and that of seawater. In this manner, the loaded crude oil occupies gradually the internal space of the tank beneath the floating roof 3. The crude oil solidifies gradually, and finally, a large block of solidified crude oil having a shape corresponding to the shape of the tank floats on the underlying seawater layer 17'.

When it is desired to unload the crude oil from the tank, a heater 26' mounted on the inside face of the tank side wall 1'' is energized to heat to fluidize the crude oil portion in contact with the inside face of the tank side wall 1'' so as to permit vertical movement of the entire oil block 2, and at the same time, a top heater 4 is energized to heat to fluidize the upper portion of the oil block 2. With the gradual unloading of the fluidized crude oil portion, the oil block 2 moves upward resulting in the corresponding rise of the surface level of the underlying seawater layer 17'. A plurality of such tanks are preferably advantageously connected together to constitute a large-capacity crude oil storage.

Although the aforementioned embodiments have referred to the storage of heavy crude oil, a mixture of such crude oil and pulverized coal may also be stored. A slurry-like fluid fuel consisting of a mixture of a liquid fuel and pulverized coal has been developed recently. This slurry fuel has such a drawback that the pulverized coal separates and precipitates when stored still in a tank or the like, and it is very difficult to re-mix uniformly the separated liquid and coal for the purpose of use. The present invention is effectively applicable to the storage of such a slurry fuel, so that a desired amount of the fuel consisting of the liquid and coal mixed at a predetermined mixture ratio can be taken out as required, because the fuel is stored in a solidified form in which the predetermined mixture ratio is maintained.

Figure 5:
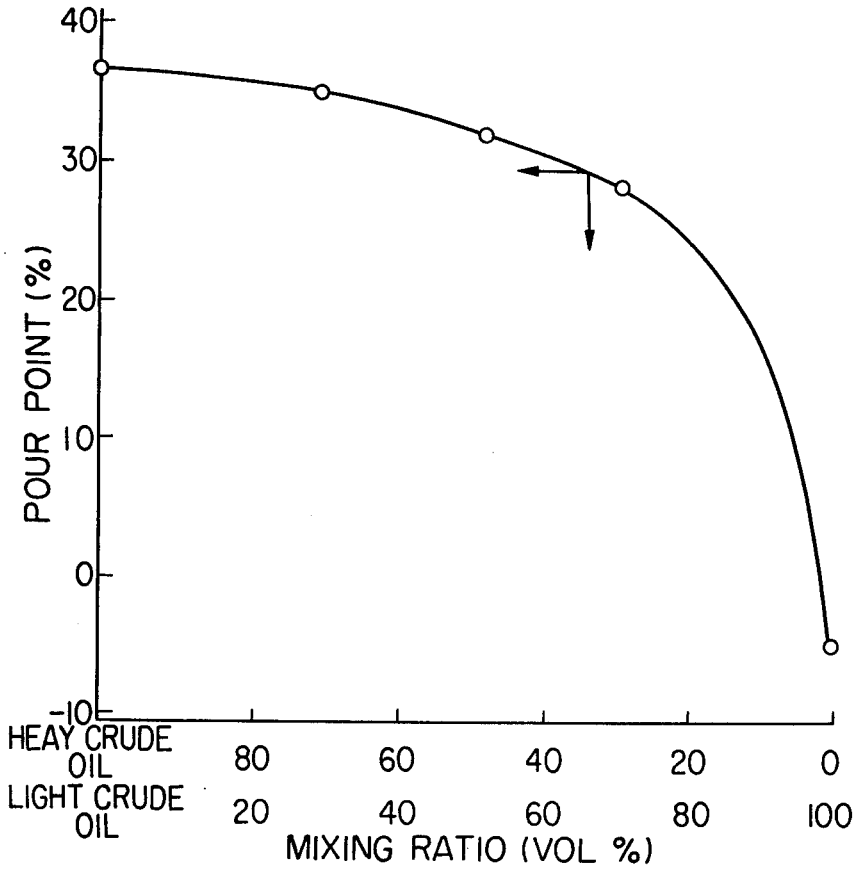
FIG. 5 is a graph showing the variation of the pour point of light crude oil when heavy crude oil is mixed in the light crude oil.

The present invention is applicable not only to the storage of the aforementioned kind of heavy crude oil but also to the storage of light crude oil having a lower pour point. As shown in FIG. 5, the pour point of light crude oil sharply increases to reach a value close to 30° C. when about 35% of heavy crude oil is mixed in the light crude oil. Such a crude oil mixture can be stored in a manner entirely similar to the storage of heavy crude oil alone.

The present invention is also applicable to the storage of a petroleum product such as naphtha, in addition to the application to crude oil. That is, when, for example, a high-molecular petrochemical product or wax or the like is added to the naphtha, a hydrocarbon oil having a high pour point similar to that of heavy crude oil can be obtained, and such oil can be stored in an entirely similar manner. In the case of unloading and separation of the hydrocarbon oil stored in the form above described, it is merely necessary to heat it to a temperature above the pour point and pass it through a filter while allowing to cool down for crystallizing the wax, etc., and fractional distillation is entirely unnecessary.

The present invention is directly applicable to the storage of any other materials provided that they have such a high pour point or high viscosity characteristic, as that described hereinbefore.

What is claimed is:

1. A storage vessel including a side wall which defines a storing space for storing heavy hydrocarbon oil in a solidified state, a roof for substantially covering the entire top area of the storing space, said roof being on top of the heavy hydrocarbon oil contained in the storing space, a top heater positioned in said vessel below and spaced from the roof to define an unloading space between the undersurface of the roof and the top heater, said top heater covering substantially the entire area of the upper portion of said space, unloading means comprising a nozzle which projects to said storage space which contains the oil when re-fluidized, and wherein means are connected to said vessel to provide and control flow of external water into and out of the lower end portion of said vessel, and said heavy hydrocarbon oil is stored in its solidified form in said vessel which oil is afloat on water in the storage vessel.

2. A vessel for storing heavy hydrocarbon oil in its solidified form as in claim 1, where a second heating means is provided within the vessel extending a major portion of the height of the vessel in proximity to the inner surface of the vessel.

3. A storage vessel as in claim 1, where said top heater is fixed in position in relation to said storage vessel.

* * * * *